US007895853B2

(12) United States Patent
Tillman, Jr. et al.

(10) Patent No.: US 7,895,853 B2
(45) Date of Patent: Mar. 1, 2011

(54) PALLET PLATFORM WITH COOL AIR TOWER

(75) Inventors: Bernard W. Tillman, Jr., Houston, TX (US); Henry A. Davis, San Clemente, CA (US)

(73) Assignee: Isolate, Inc., Houston, TX (US)

( * ) Notice: Subject to any disclaimer, the term of this patent is extended or adjusted under 35 U.S.C. 154(b) by 423 days.

(21) Appl. No.: 12/115,836

(22) Filed: May 6, 2008

(65) Prior Publication Data

US 2009/0277610 A1 Nov. 12, 2009

(51) Int. Cl.
*A47F 3/04* (2006.01)

(52) U.S. Cl. ..... 62/255; 62/419; 465/104.19

(58) Field of Classification Search ..... 62/250, 62/255, 237, 256, 246, 427, 314, 414, 185, 62/419; 165/104.19, 104.28, 108; 312/116, 312/401; 454/139, 205, 233
See application file for complete search history.

(56) References Cited

U.S. PATENT DOCUMENTS 3,690,118 A * 9/1972 Rainwater ..... 62/250
3,719,408 A * 3/1973 Fullington et al. ..... 312/236
3,933,006 A * 1/1976 South ..... 62/231
4,831,837 A * 5/1989 Negishi et al. ..... 62/239
5,261,253 A 11/1993 Spenard
5,337,579 A 8/1994 Saia, III et al.
5,475,987 A * 12/1995 McGovern ..... 62/256
5,502,979 A 4/1996 Renard
5,901,564 A * 5/1999 Comeau, II ..... 62/264
5,996,366 A 12/1999 Renard
6,263,688 B1 7/2001 Bedard
6,266,972 B1 7/2001 Bostic
6,298,672 B1 10/2001 Valicoff, Jr.
6,901,768 B1 * 6/2005 Windecker ..... 62/407
6,968,711 B2 11/2005 Smith et al.
7,310,967 B2 12/2007 Aragon
2007/0175236 A1 8/2007 Dryzun

* cited by examiner

*Primary Examiner*—Mohammad M Ali
(74) *Attorney, Agent, or Firm*—Bracewell & Giuliani LLP

(57) ABSTRACT

A cooling system for perishable items.

19 Claims, 19 Drawing Sheets

PALLET PLATFORM WITH COOL AIR TOWER

BACKGROUND

This disclosure relates to refrigeration systems for perishable items.

DETAILED DESCRIPTION

Figure 1:
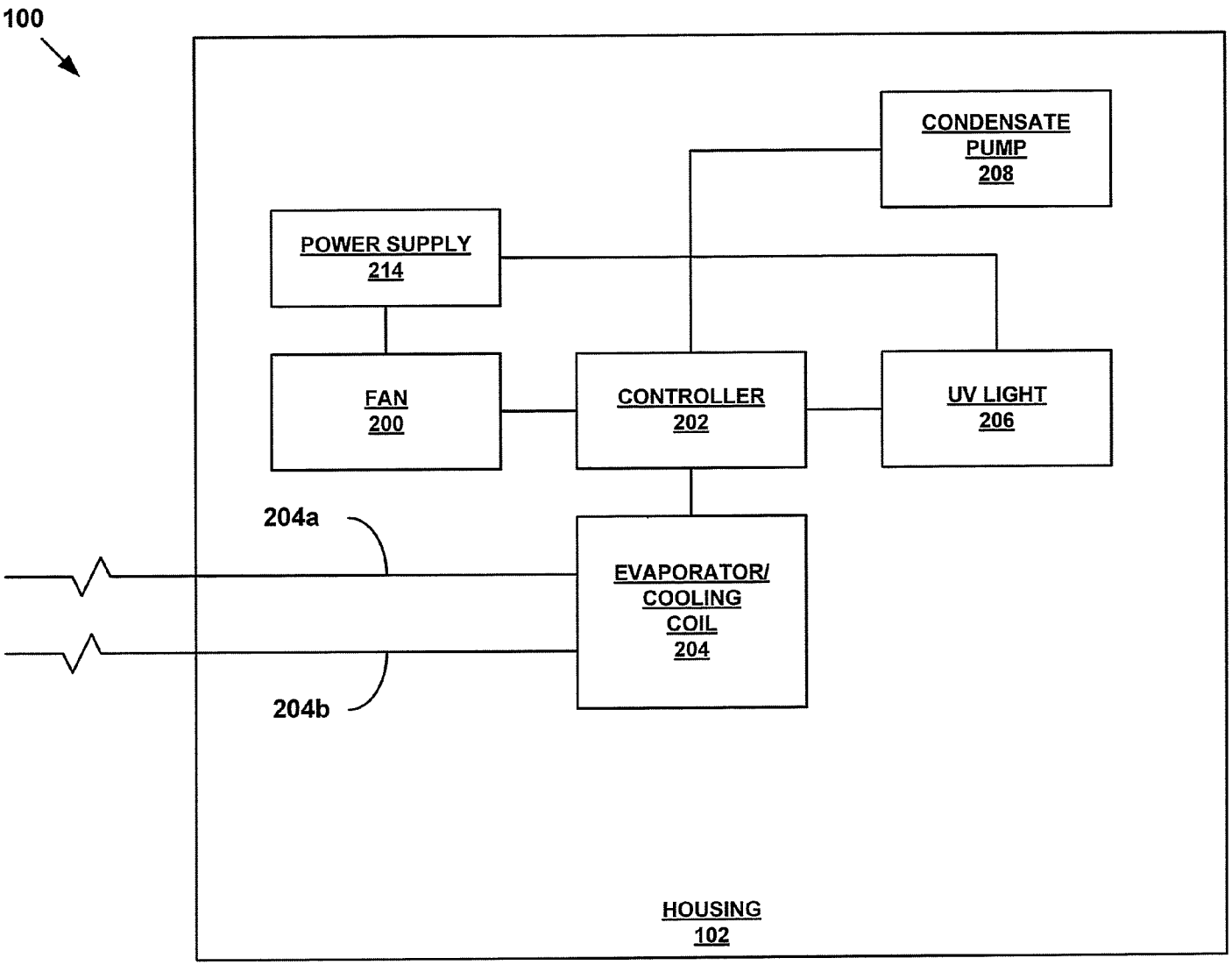
FIG. 1 is a schematic illustration of an exemplary embodiment of an apparatus for cooling perishable items.

In the drawings and description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Referring initially to FIGS. 1-14, an exemplary embodiment of an apparatus 100 for cooling perishable items includes a housing 102 having a first horizontal section 104, a second horizontal section 106, and a vertical section 108 positioned between the first and second horizontal sections. The horizontal sections, 104 and 106, and the intermediate vertical section 108 are supported from below by spaced apart support members, 110, 112, and 114, that span the length of the apparatus 100. In this manner, hollow portions, 116 and 118, are defined between the support members, 110 and 112, and 112 and 114, respectively. The horizontal sections, 104 and 106, and the intermediate vertical section 108 are also supported from below by end plates, 120 and 122, positioned at opposite ends of the apparatus 100, that are connected to opposite ends of the support members, 110, 112, and 114.

The first horizontal section 104 includes an air passageway 124 at one end that is fluidicly coupled with ends of the hollow portions, 116 and 118, and the second horizontal section 106 includes an air passageway 126 at one end that is fluidicly coupled with the other ends of the hollow portions, 116 and 118. In an exemplary embodiment, both of the passageways, 124 and 126, include slotted air intakes.

The end plates 120 and 122 include air passageways, 128 and 130, respectively, that are each fluidicly coupled with opposite ends of the hollow portions, 116 and 118. In an exemplary embodiment, both of the air passageways, 128 and 130, include slotted air intakes.

The vertical section 108 includes opposing vertical side walls, 132 and 134 and 136 and 138, and a top end wall 140. The vertical side walls, 132, 134, 136 and 138 and the top end wall 140 together define an internal vertical air passage 142 that is fluidically coupled to the hollow portions, 116 and 118, are defined between the support members, 110 and 112, and 112 and 114, respectively.

The vertical wall 132, which also faces the horizontal section 104, defines a passageway 144 that is fluidicly coupled to the vertical passage 142. The vertical wall 134, which also faces the horizontal section 106, defines a passageway 146 that is fluidicly coupled to the vertical passage 142. In an exemplary embodiment, the passageways, 144 and 146, include slotted air discharge diffusers.

In an exemplary embodiment, one or more fans 200 are positioned and supported within the vertical passage 142 of the housing 102 for displacing air upwardly within the vertical passage. In an exemplary embodiment, the fans 200 are operably coupled to a controller 202 for controlling the operation of the fans.

In an exemplary embodiment, one or more evaporator cooling coils 204 are positioned and supported within the vertical passage 142 of the housing 102 at a location proximate and below the fans 200. In an exemplary embodiment, the evaporator coils 204 include and inlet **204*a* and an outlet 204*b* that permit a chilled fluidic material such as, for example, chilled water and glycol, or any refrigerant, to be transmitted through the coils. In this manner, the operation of the evaporator coil 204 provides a refrigeration system for the apparatus 100. In this manner, as air is displaced upwardly within vertical passage 142 of the housing 102, the air is cooled as it passes over and through the evaporator coils 204**.

In an exemplary embodiment, one or more ultraviolet ("UV") lights 206 are positioned and supported within the vertical passage 142 of the housing 102 at a location proximate and below the fans 200. In an exemplary embodiment, the UV lights 206 are operably coupled the controller 202 for controlling and monitoring the operation of the UV lights. In this manner, as air is displaced upwardly within vertical passage 142 of the housing 102, mold, bacteria, and other organisms are exposed to the UV light-generated by the UV lights 206 thereby killing organisms present in the air.

In an exemplary embodiment, a condensate pump 208 and condensate drain pan 210 are positioned and supported within the housing 102 at a location proximate and below the evaporator coils 204. In particular, in an exemplary embodiment, the condensate drain pan 210 is positioned below the evaporator coils 204 in order to catch condensation generated during the operation of the evaporator coils. In an exemplary embodiment, an inlet of the condensate pump 208 is fluidicly coupled to the interior of the condensate drain pan 210 in order to permit the condensate pump to pump condensation captured by the condensate drain pan out of the pan in into an overhead drain system 212 provided in the building that houses the apparatus 100.

In an exemplary embodiment a power supply 214 is positioned and supported within the housing 102 for supplying power to the fans 200, the controller 202, the UV lights 206 and the condensate pump 208.

Figure 2:
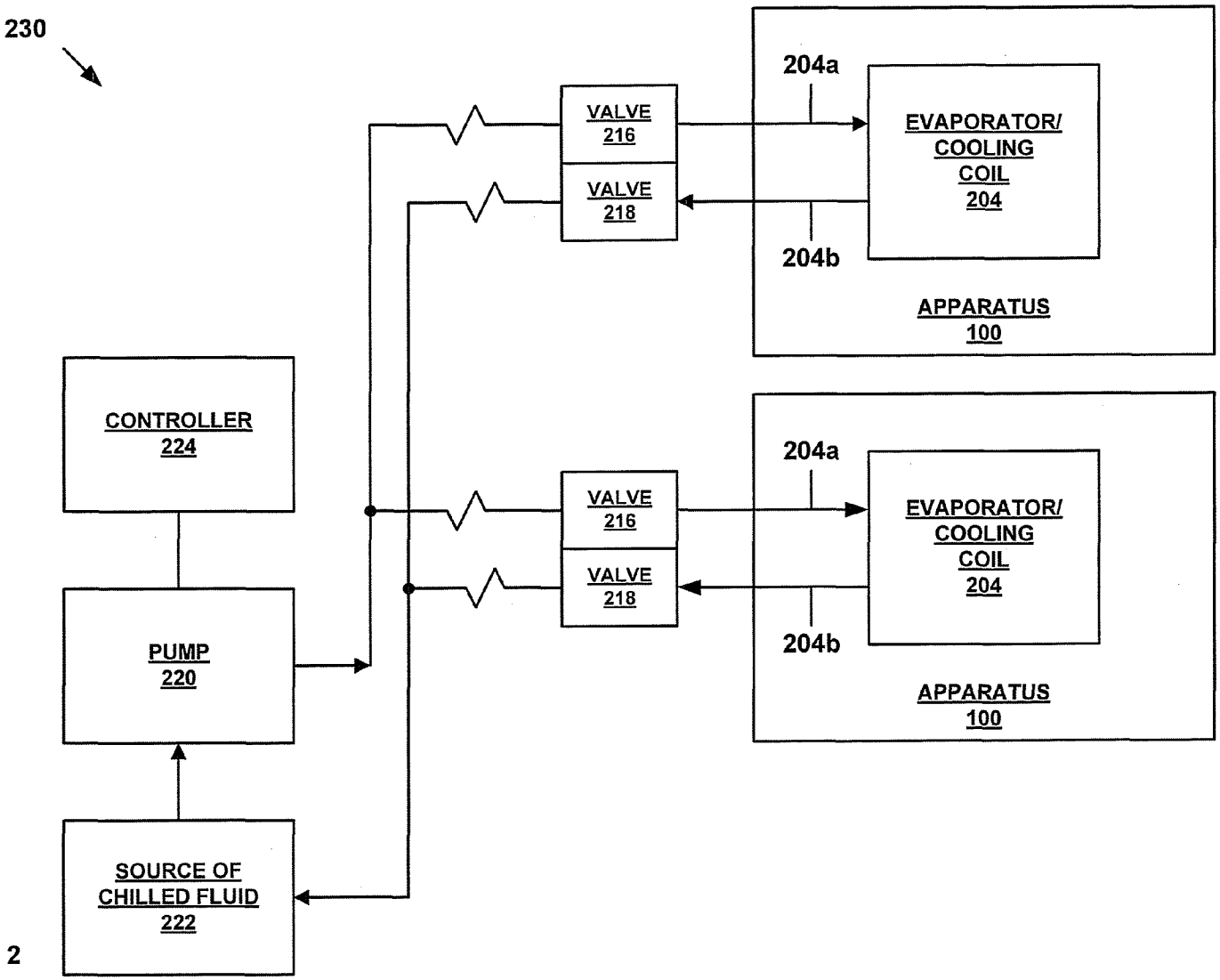
FIG. 2 is a schematic illustration of an exemplary embodiment of a system for cooling perishable items that includes one or more of the apparatus of FIG. 1.
Figure 3:
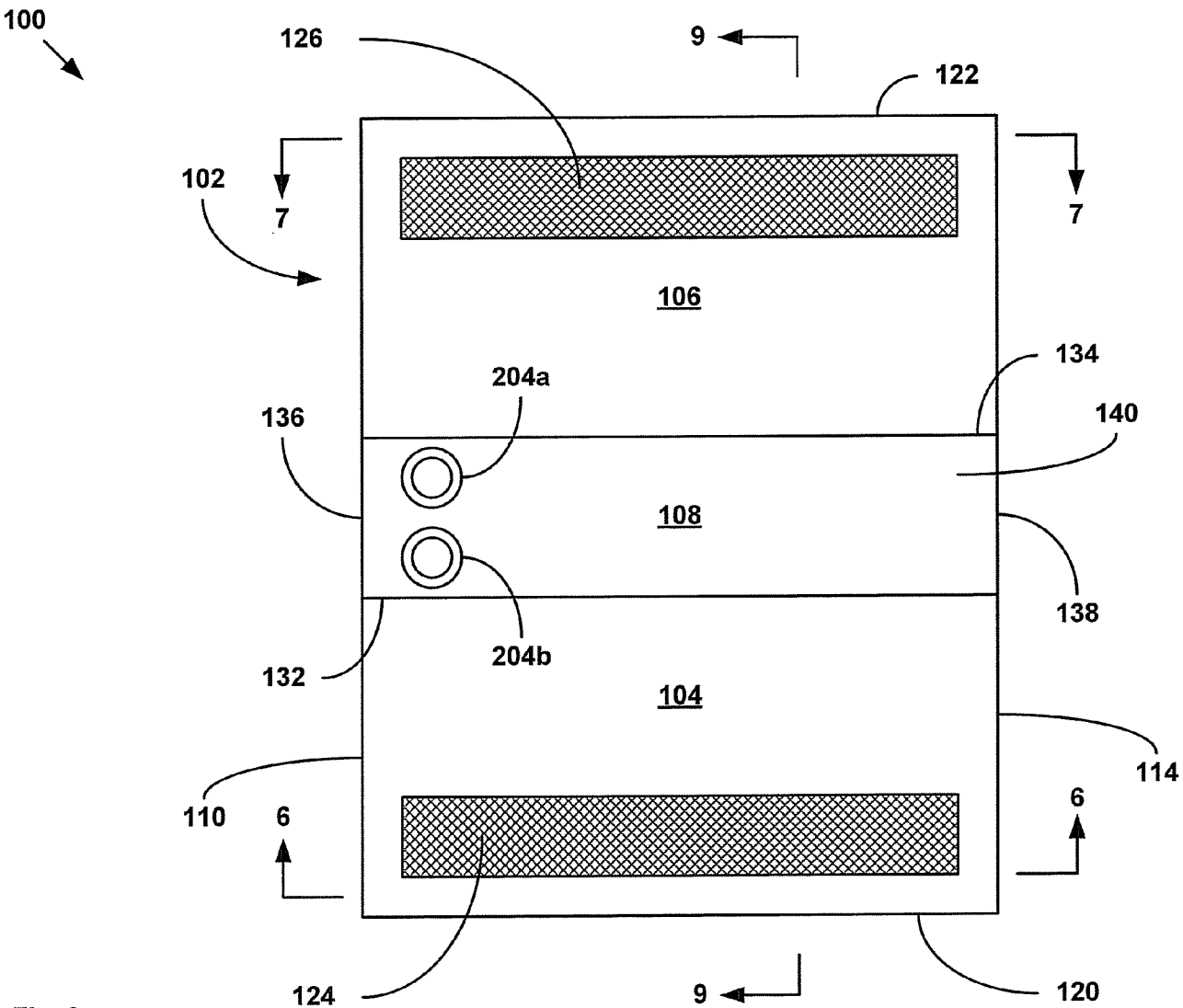
FIG. 3 is a top plan view of the apparatus of FIG. 1.
Figure 4:
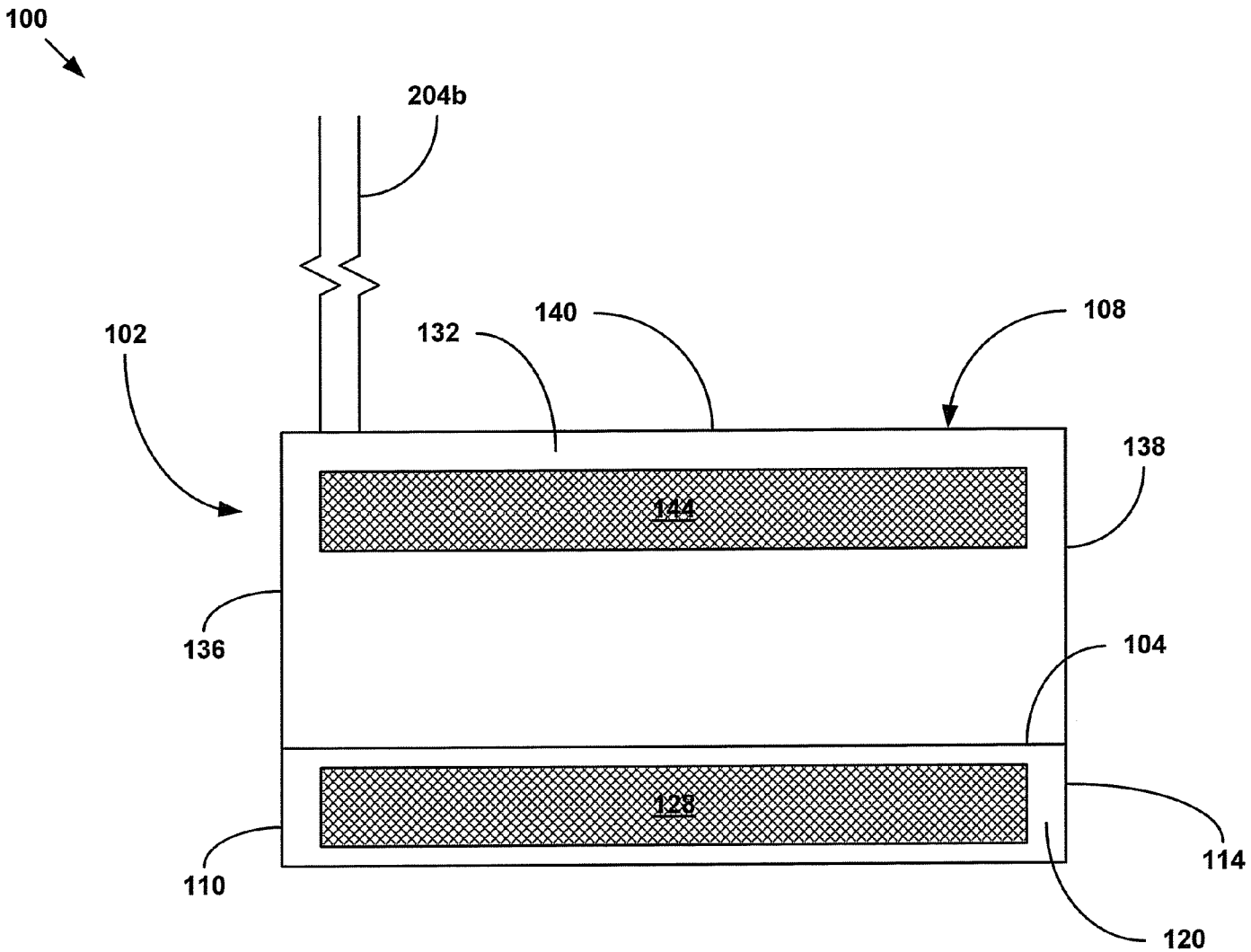
FIG. 4 is a side elevation view of the apparatus of FIG. 3.
Figure 5:
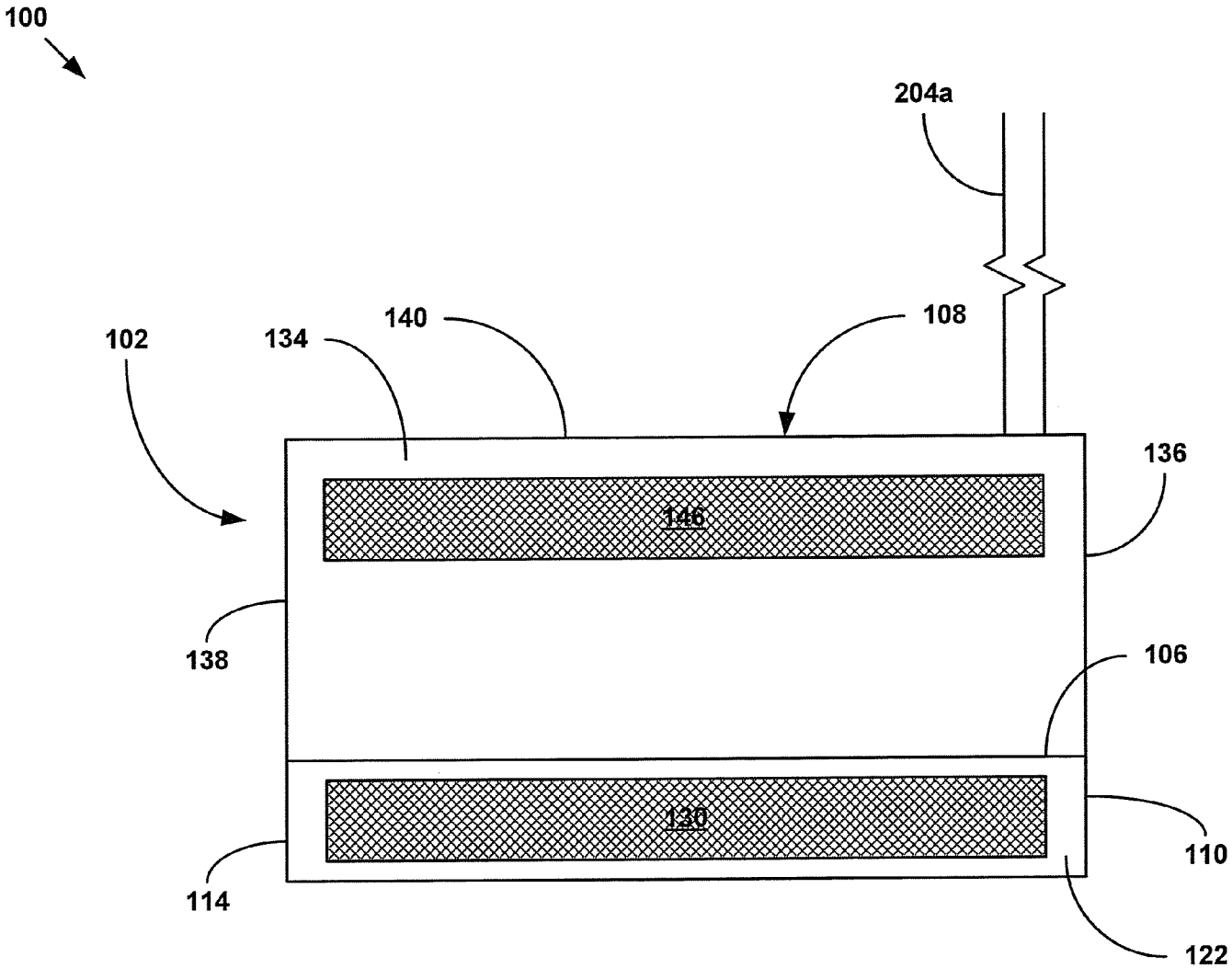
FIG. 5 is an opposite side elevation view of the apparatus of FIG. 3.
Figure 6:
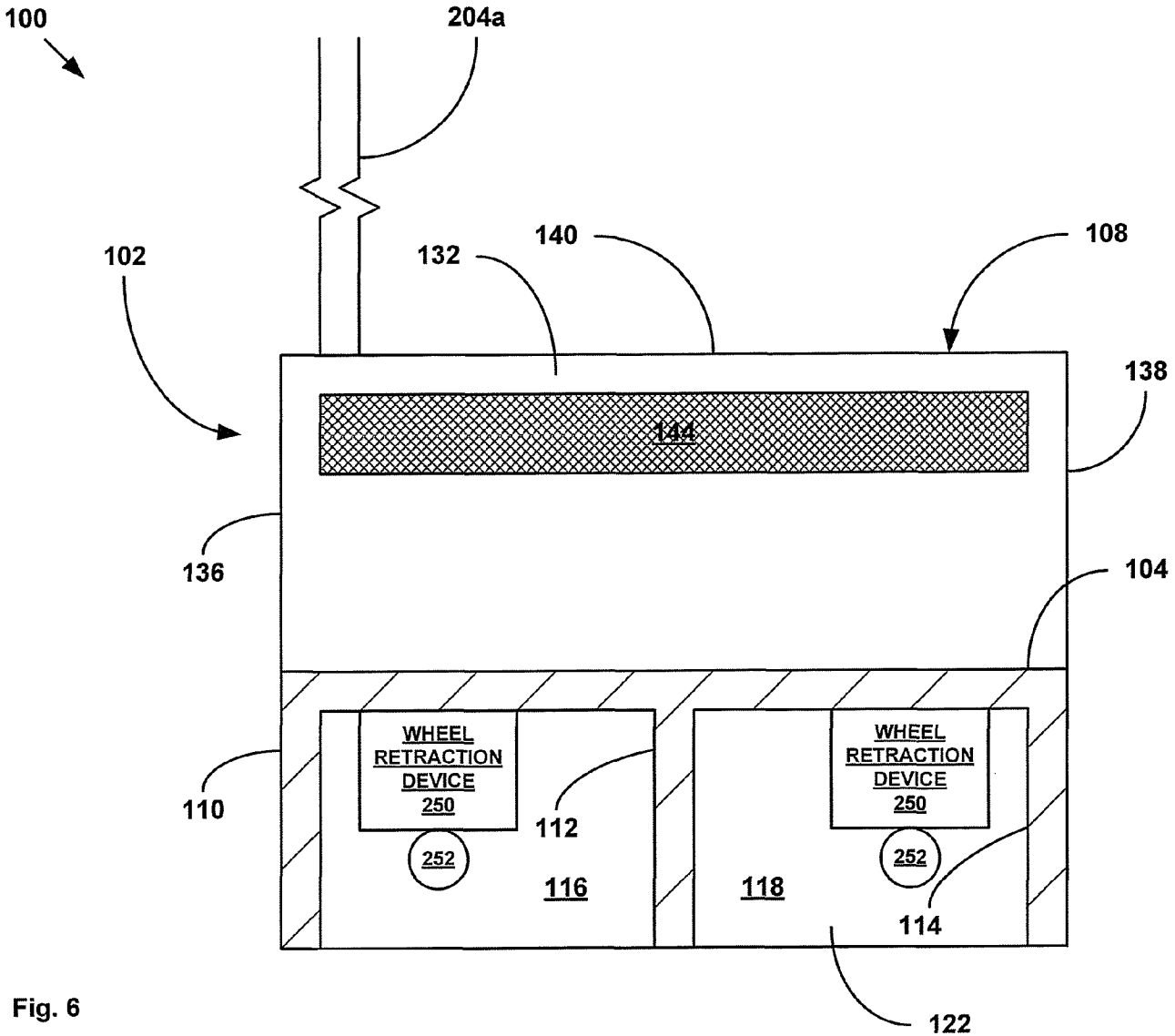
FIG. 6 is a fragmentary cross sectional view of the apparatus of FIG. 3.
Figure 7:
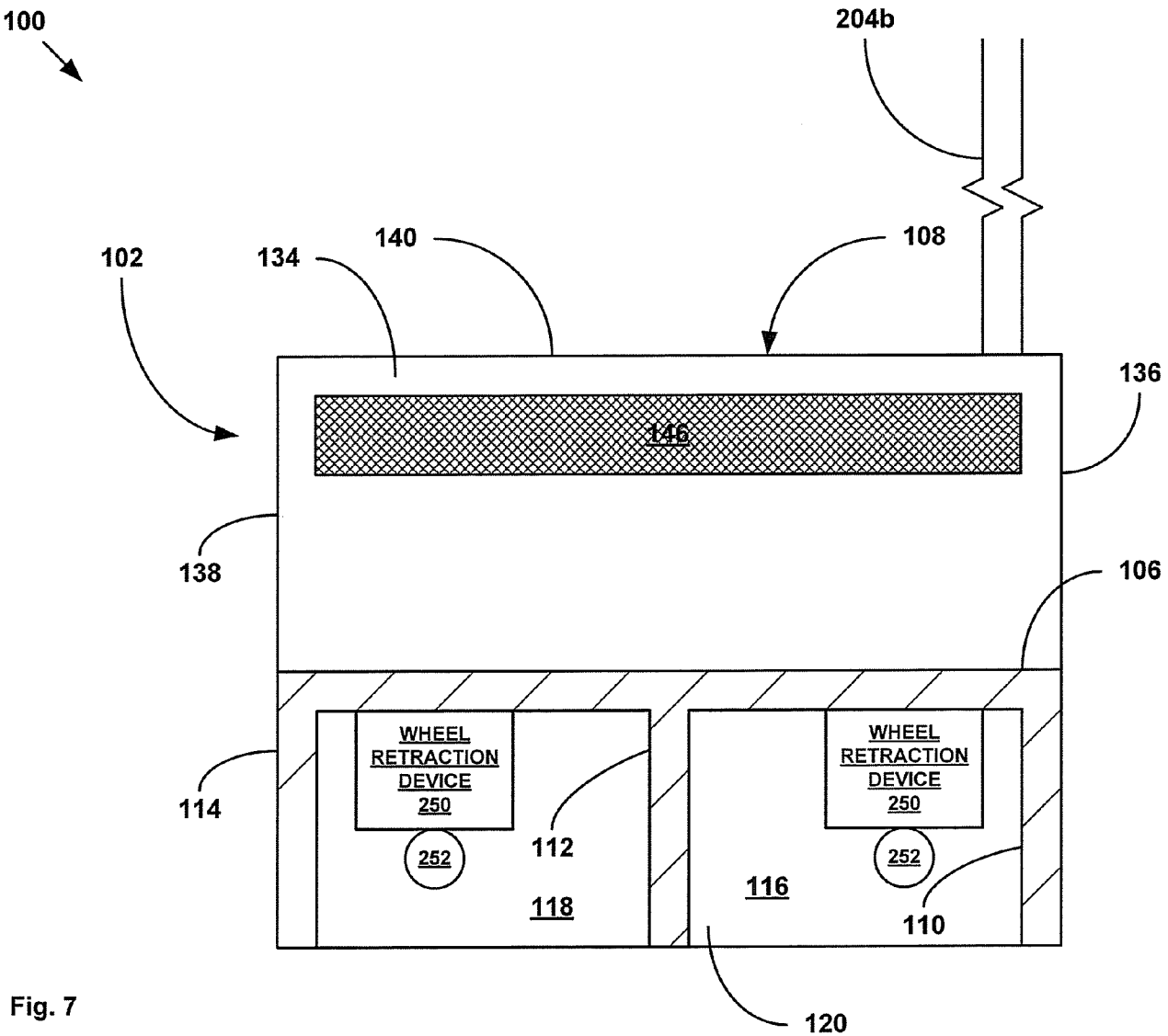
FIG. 7 is another fragmentary cross sectional view of the apparatus of FIG. 3.
Figure 8:
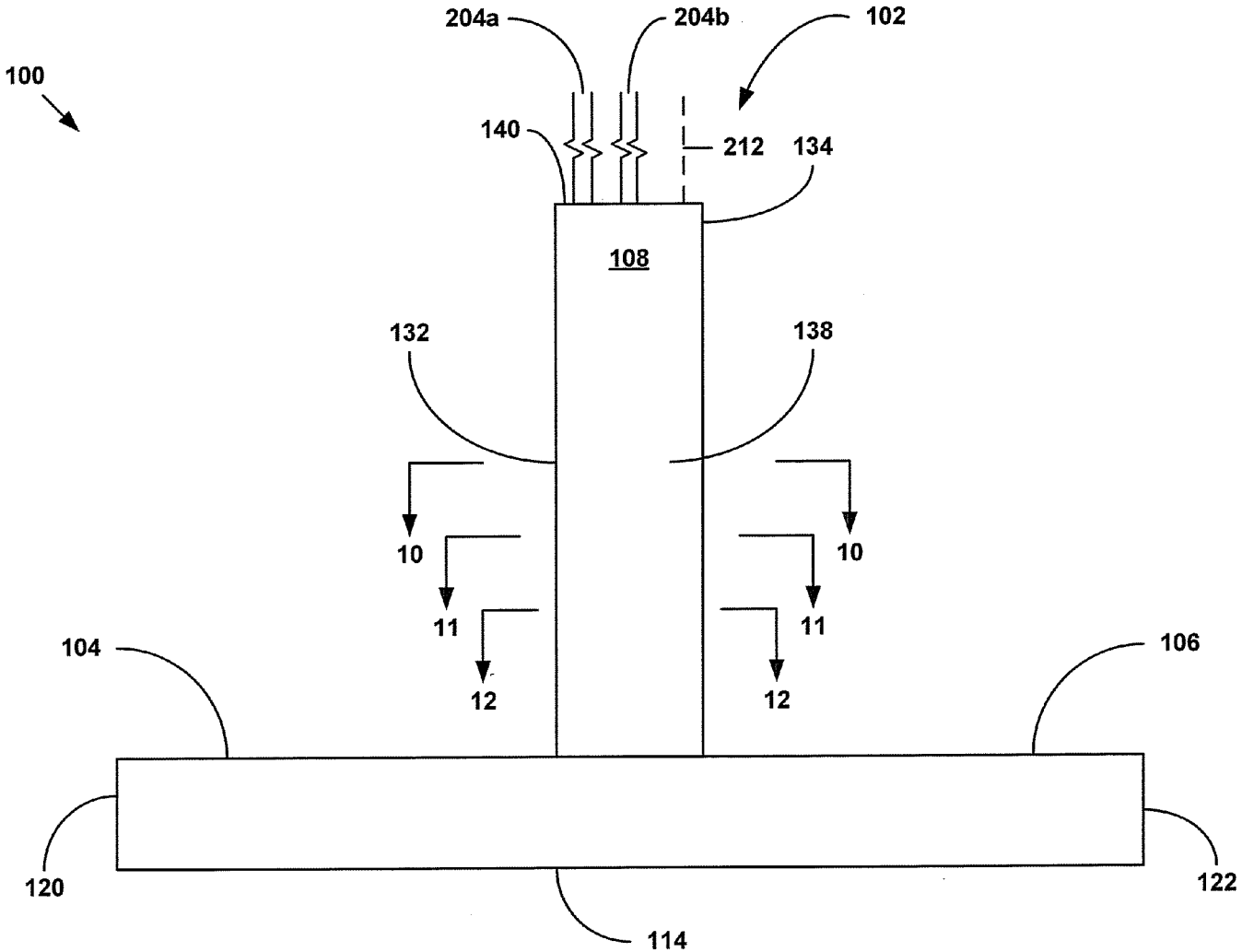
FIG. 8 is an end side elevation view of the apparatus of FIG. 3.
Figure 9:
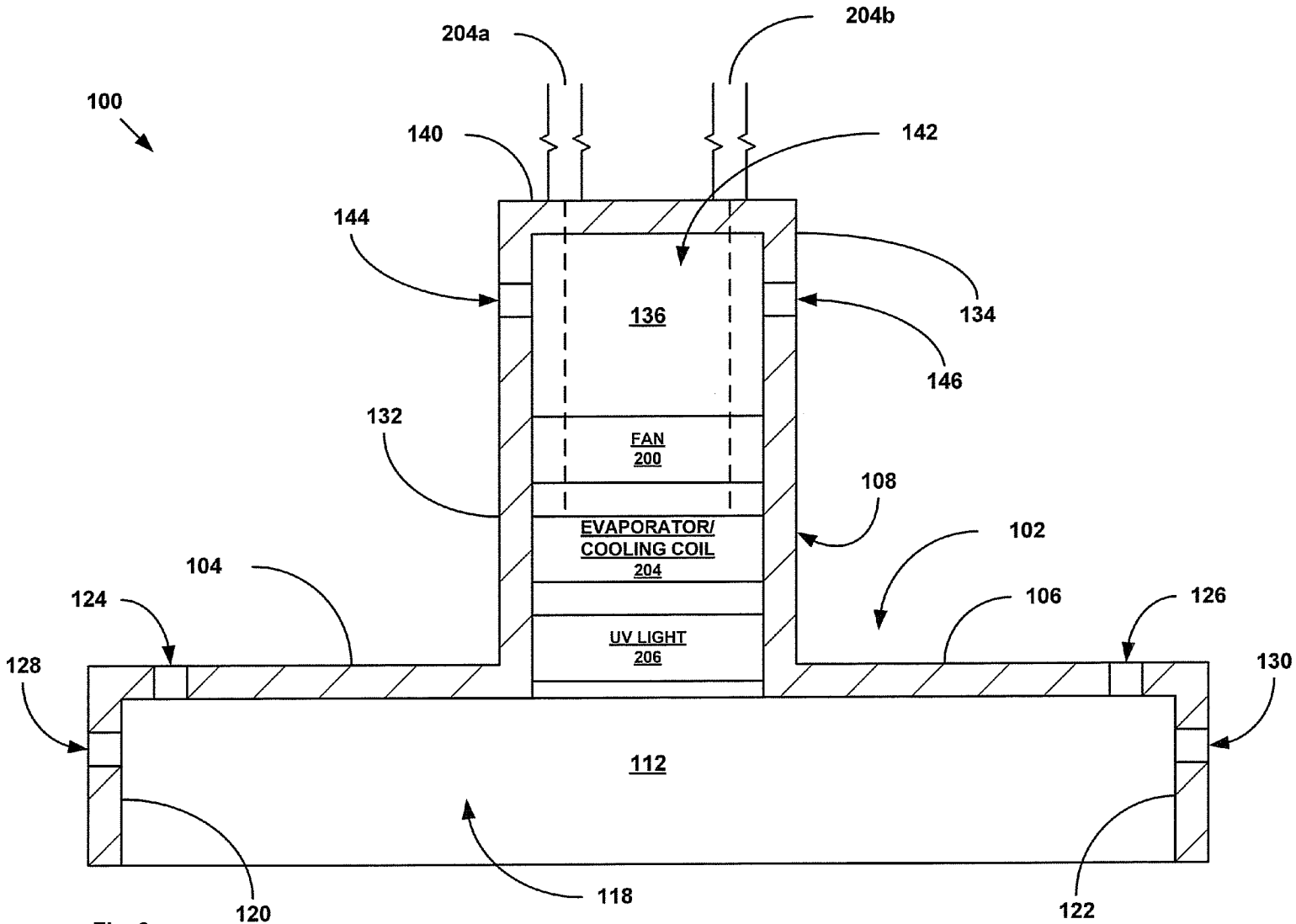
FIG. 9 is another fragmentary cross sectional view of the apparatus of FIG. 3.
Figure 10:
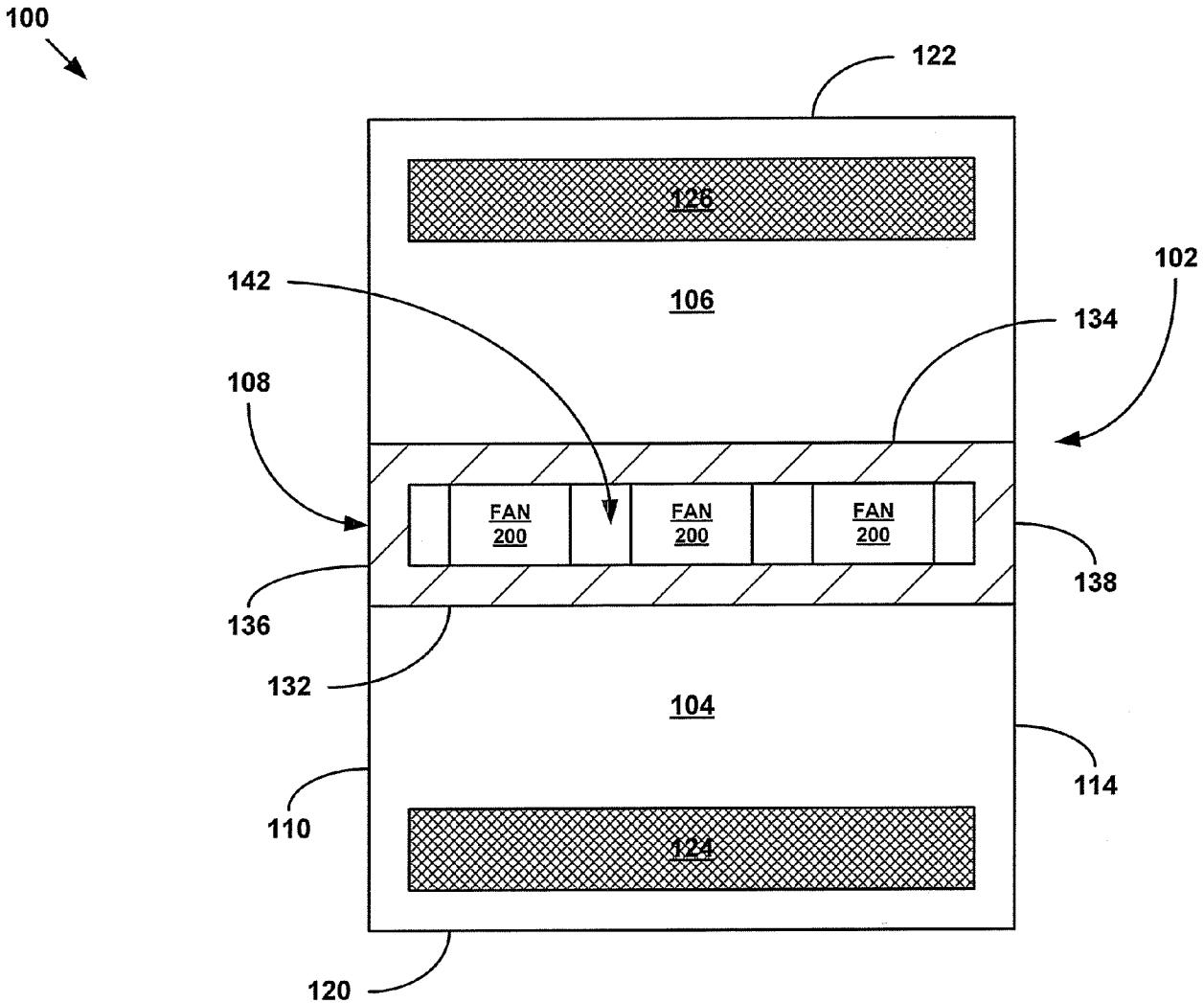
FIG. 10 is a fragmentary cross sectional view of the apparatus of FIG. 8.
Figure 11:
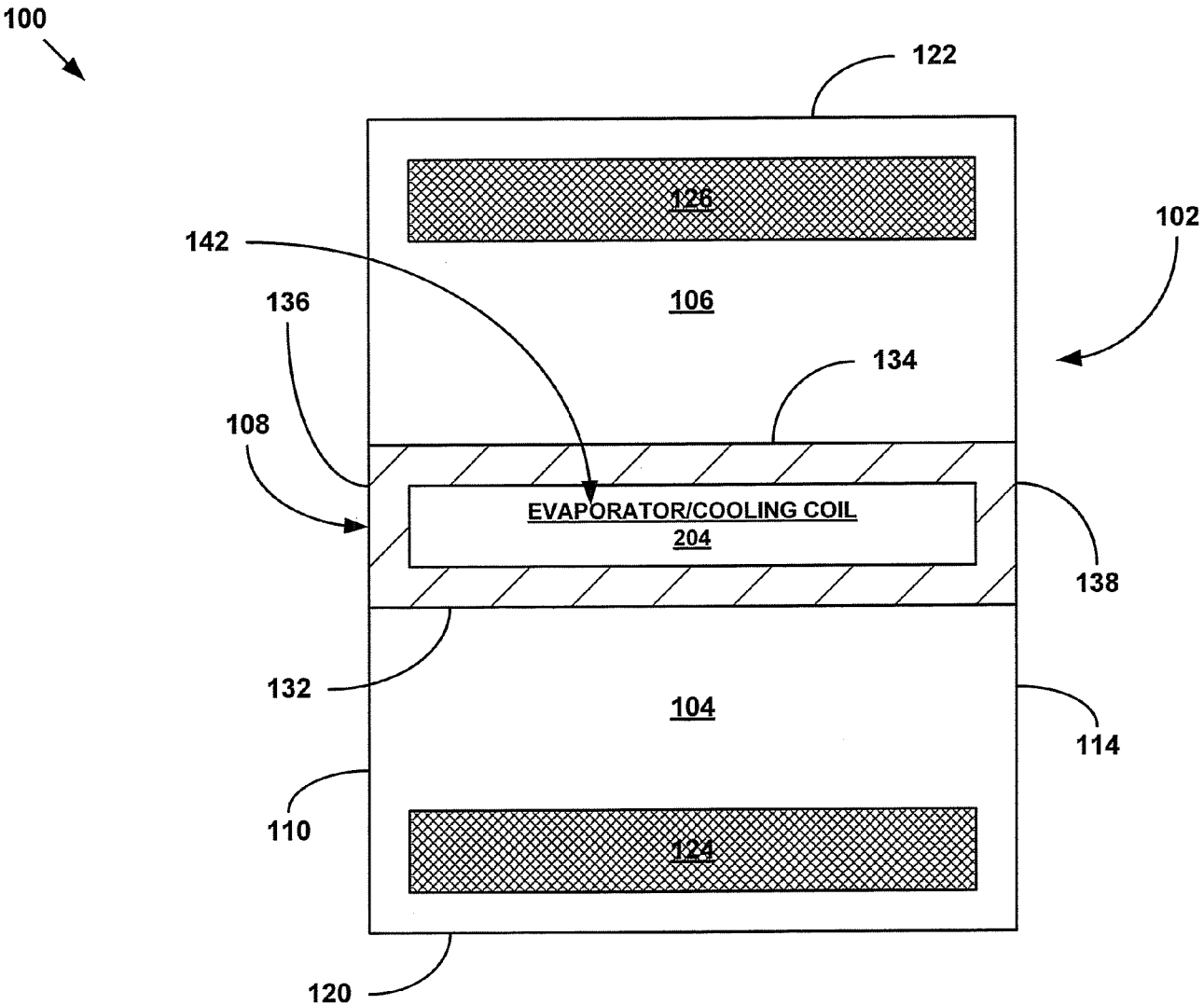
FIG. 11 is another fragmentary cross sectional view of the apparatus of FIG. 8.
Figure 12:
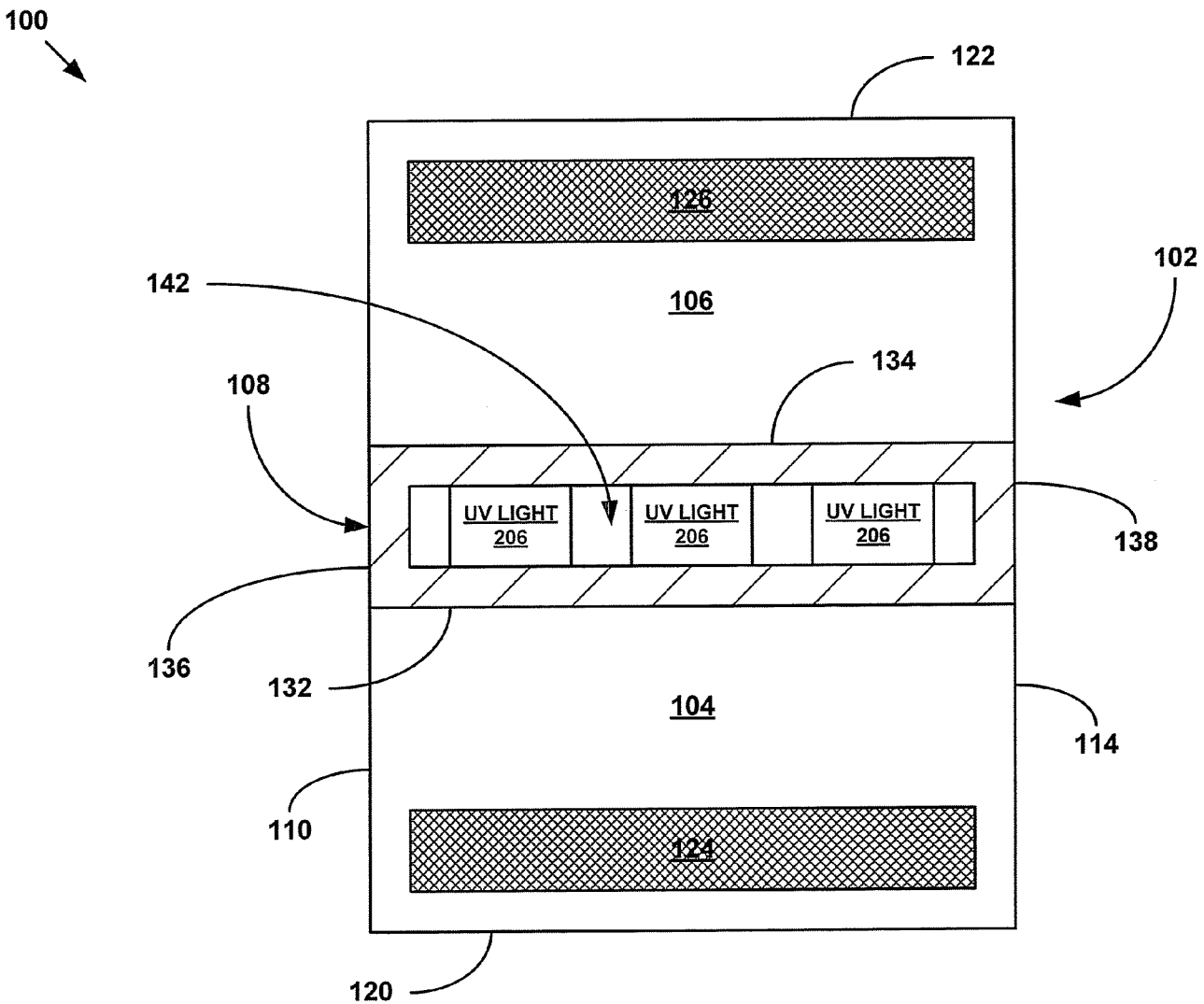
FIG. 12 is another fragmentary cross sectional view of the apparatus of FIG. 8.
Figure 13:
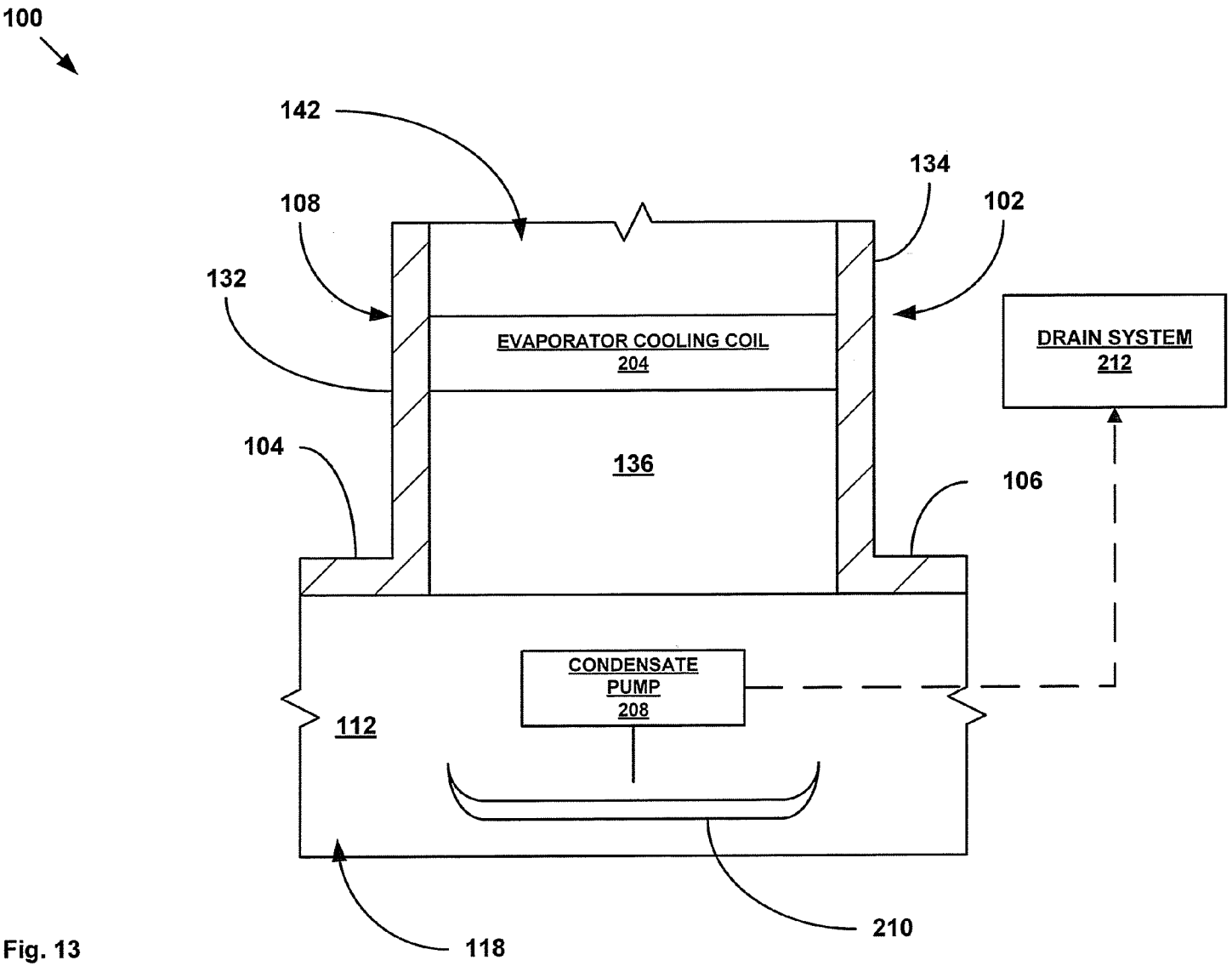
FIG. 13 is another fragmentary cross sectional view of the apparatus of FIG. 3.
Figure 14:
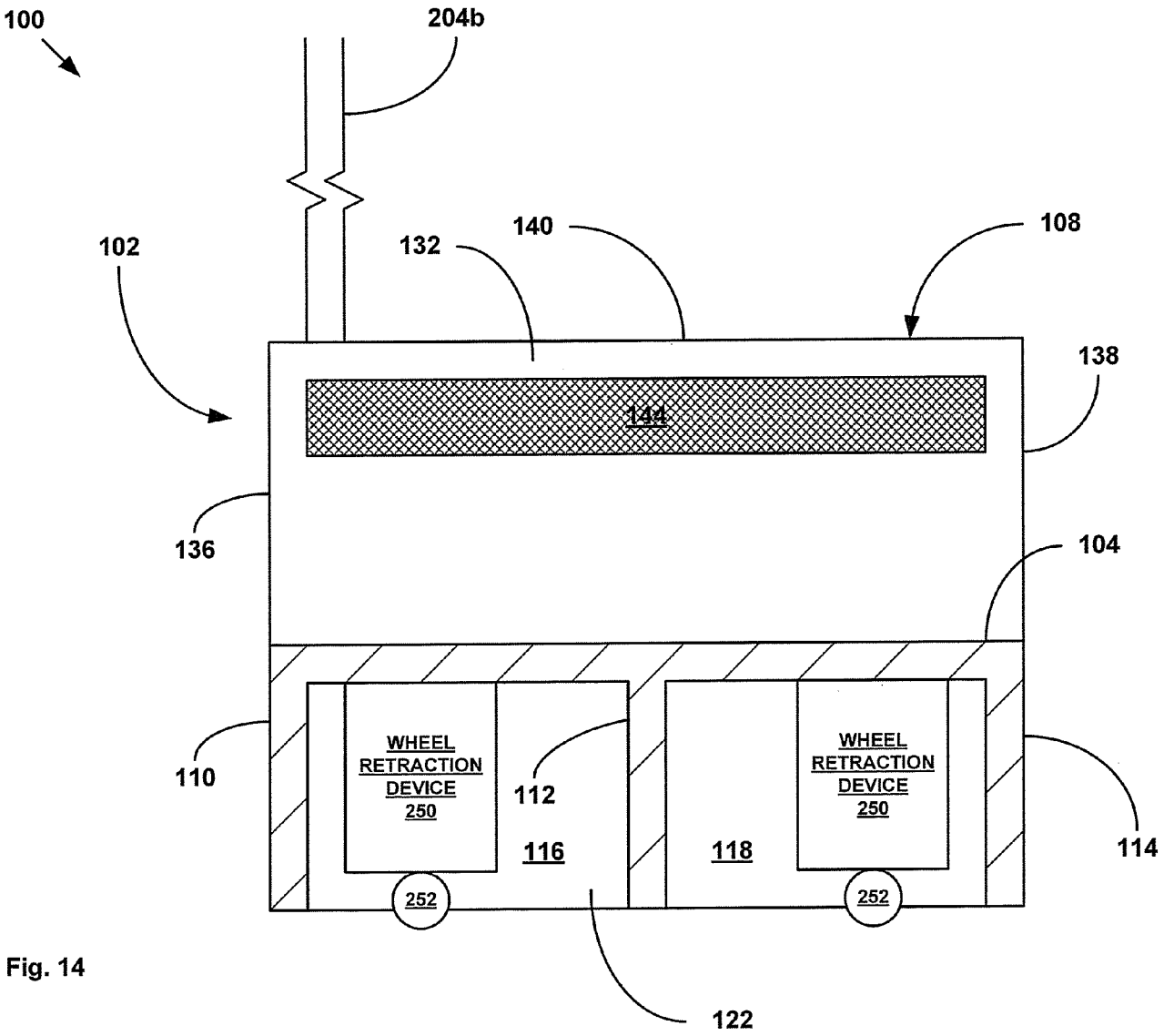
FIG. 14 is a fragmentary cross sectional view of the apparatus of FIG. 3 illustrating the movement of the apparatus.

In an exemplary embodiment, the inlet and outlets, 204*a* and 204*b*, respectively, of the evaporator coil 204 is operably coupled to corresponding flow control valves, 216 and 218, in order to control the flow of the chilled fluidic material through the evaporator coil 204. In an exemplary embodiment, the inlets and outlets, 204*a* and 204*b*, are provided in the form of removable umbilical connections that extend upwardly out of the housing 102. The control valves 216 are also operably coupled to the outlet of a pump 220, and the inlet of the pump 220 is operably coupled to a source 222 of a chilled fluid. In an exemplary embodiment, the chilled fluid may, for example, be a mixture of water and glycol, or any chilled refrigerant. A controller 224 is operably coupled to the pump 220 for controlling the operation of the pump. In this manner, one or more of the apparatus 100 may be operated to chill perishable items by pumping a chilled fluid through the evaporator coils 204 while operating the fans 200 of the apparatus thereby generating a cooling air stream. In an exemplary embodiment, the controller 224 may also communicate with the controllers 202 of the apparatus 100 in order to coordinate the monitoring and control of one or more the apparatus. In this manner, as illustrated in FIG. 2, a system 230 for cooling perishable items is provided that permits a plurality of the apparatus 100 to be operated under the control of the controller 224.

In an exemplary embodiment, one or more conventional wheel retraction devices 250 are positioned within the hollow portions, 116 and 118, and coupled to the horizontal sections, 104 and/or 106, of the apparatus 100, and conventional rollers 252 are coupled to the lower ends of the wheel retraction devices. In one mode of operation, the devices 250 are operated to position the rollers 252 within the hollow portions, 116 and 118, of the housing 102. In another mode of operation, the devices 250 are operated to position the rollers 252 extending out of the hollow portions, 116 and 118, of the housing 102. In this manner, the apparatus 100 may be wheeled along the surface of the floor and then, once repositioned, the devices 250 may be operated to position the rollers 252 back within the hollow portions, 116 and 118, of the housing 102 in a retracted position.

Figure 15:
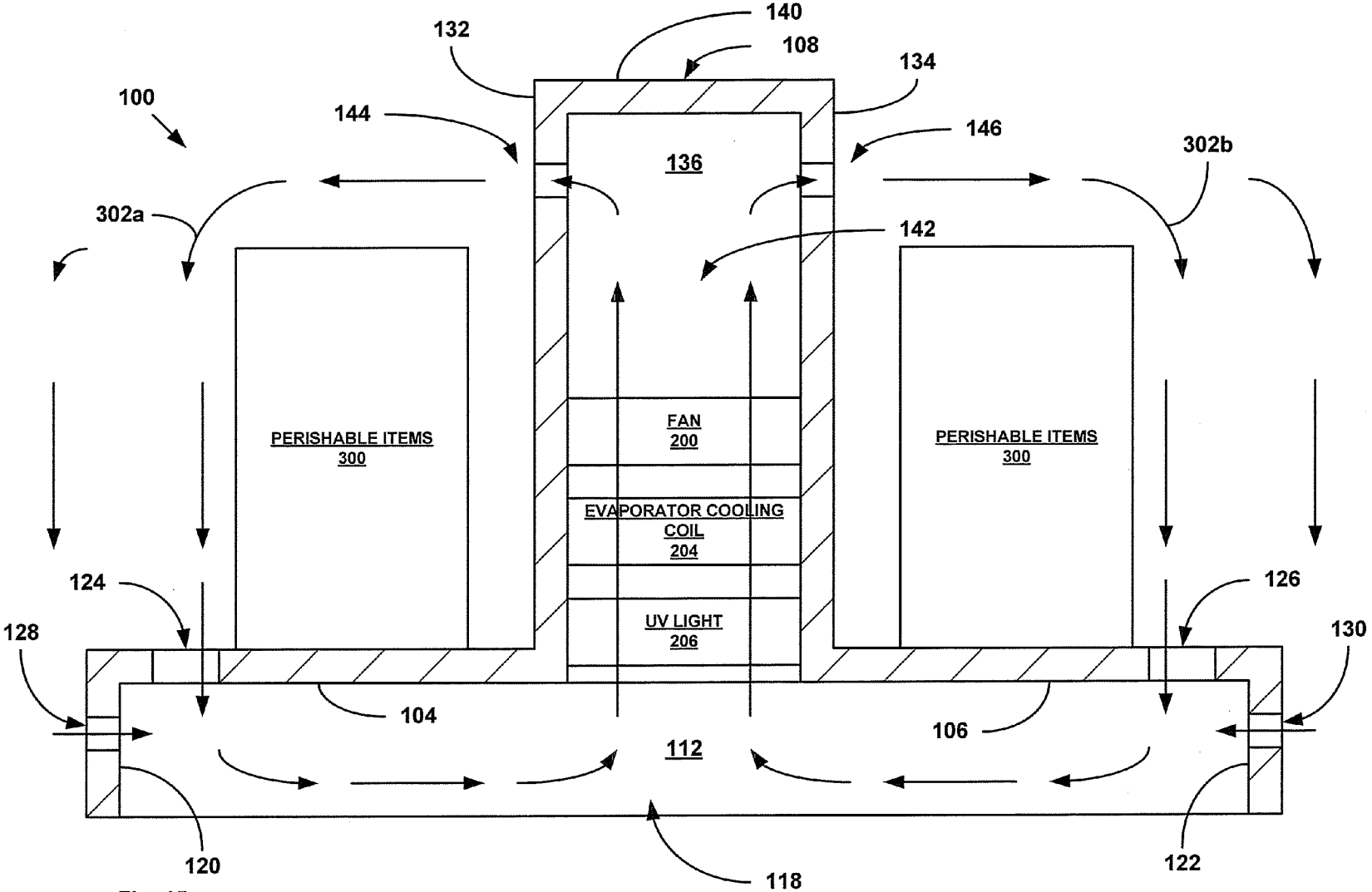
FIG. 15 is a fragmentary cross sectional view of the apparatus of FIG. 3 illustrating the operation of the apparatus.

In an exemplary embodiment, during operation of the apparatus 100, as illustrated in FIG. 15, perishable food items 300 may be placed on the horizontal sections, 104 and 106, of the apparatus. A chilled fluidic material such as, for example, a mixture of water and glycol, or any refrigerant, may then be pumped through the evaporator coil 204 by operation of the valves, 216 and 218, and pump 220 under the control of the controller 224. The fan 200 and UV light 206 may then be operated under the control of the controller 202. As a result, air may be drawn from the hollow portions, 116 and 118, into the lower portion of the vertical passage 142. As a result, the air may be cooled by operation of the evaporator coil 204 and mold, bacteria, and other organisms within the air killed by operation of the UV lights 206. The air may then pass into the upper portion of the vertical passage 142 and then out of the passageways, 144 and 146, defined on the vertical walls, 132 and 134, respectively. The air passing out of the passageways, 144 and 146, then passes over the food items 300 thereby cooling the food items. The air then passes around and past the food items 300 and is then drawn into the passageways, 124 and 126, defined at the outward ends of the horizontal sections, 104 and 106, respectively, and the passageways, 128 and 130, defined in the end plates 120 and 122, respectively. The air drawn into the passageways, 124 and 126, defined at the outward ends of the horizontal sections, 104 and 106, respectively, and the passageways, 128 and 130, defined in the end plates 120 and 122, respectively, is then drawn into the hollow portions, 116 and 118, and then back into the lower portion of the vertical passage 142. The resulting operation of the apparatus 100 thereby creates circulation paths, 302*a* and 302*b*, in each side of the system.

In an exemplary embodiment, the circulation paths, 302*a* and 302*b*, at least partially re-circulate air within the apparatus 100. In an exemplary embodiment, during operation of the apparatus 100, air may also be drawn into the hollow portions, 116 and 118, of the housing 102 through the passageways, 128 and 130, defined in the end plates, 120 and 122, respectively.

In an exemplary experimental embodiment of the apparatus 100, approximately 50 to 60 percent of the air circulated in the circulation paths, 302*a* and 302*b*, was re-circulated during operation of the system. As a result, the non-re-circulated air was diffused into the general immediate vicinity of the perishable items 300. As a result, the air in this general immediate vicinity of the perishable items 300 was cool, but not as cold as the air flow for cooling the perishable items. As a result, the exemplary experimental embodiment of the apparatus 100 provided a cool air zone in the general immediate vicinity of the perishable items 300 that users of the system such as, for example, test customers, found pleasant. All of the above experimental results were unexpected. Furthermore, as opposed to conventional refrigerated cabinets used for displaying produce and other food items in commercial establishments, the exemplary experimental embodiment of the food items 100 was found to provide a more accessible display system for cooling produce and other perishable items such as, for example, flowers.

In an exemplary embodiment, the vertical positions of the air passageways, 144 and 146, permit the air to be circulated over the top surfaces of the perishable items 300.

In an exemplary embodiment, each of the circulation paths, 302*a* and 302*b*, provide up to about 2,000 to 3,000 cubic feet per minute of circulation.

In an exemplary embodiment, the housing 102 of the apparatus 100 may include one or more removable panels to permit access to the interior of the housing to permit installation and/or maintenance of the equipment within the housing.

In an exemplary embodiment, the passageway 144 in the vertical wall 132 is positioned in opposing relation to passageway 146 in the vertical wall 134.

In an exemplary embodiment, each of the passageways, 144 and 146, include slot diffusers that may provide laminar air flow over the perishable items 300. In an exemplary embodiment, the slot diffusers, 144 and 146, provide an exit velocity of less than about 700 feet per minute of the air discharged over the food items 300 that may provide enhanced re-circulation of the air in the apparatus 100.

In an exemplary embodiment, the apparatus 100 may be positioned within a commercial establishment using a conventional fork lift whereby the forks of the fork lift are inserted into the hollow portions, 116 and 118, of the housing 102. In this manner, the apparatus 100 may be easily and efficiently positioned within a commercial establishment. In an exemplary embodiment, the apparatus 100 may then be repositioned within the commercial establishment by operating the wheel retraction devices 250 and rollers 252 as described above.

In an exemplary embodiment, the apparatus 100 may provide the following performance characteristics:

| PERFORMANCE CHARACTERISTIC | PERFORMANCE CHARACTERISTIC VALUE |
|---|---|
| Air flow rate over the coils 204 | 2,000 to 3,000 cubic feet per minute |
| Number of fans 200 | 2-4 |
| Air Temperature into the coils 204 | 75 degrees F. dry bulb/64 degrees F. wet bulb |
| Air temperature leaving the coils 204 | 35 degrees F. dry bulb/34 degrees F. wet bulb |

Figure 16:
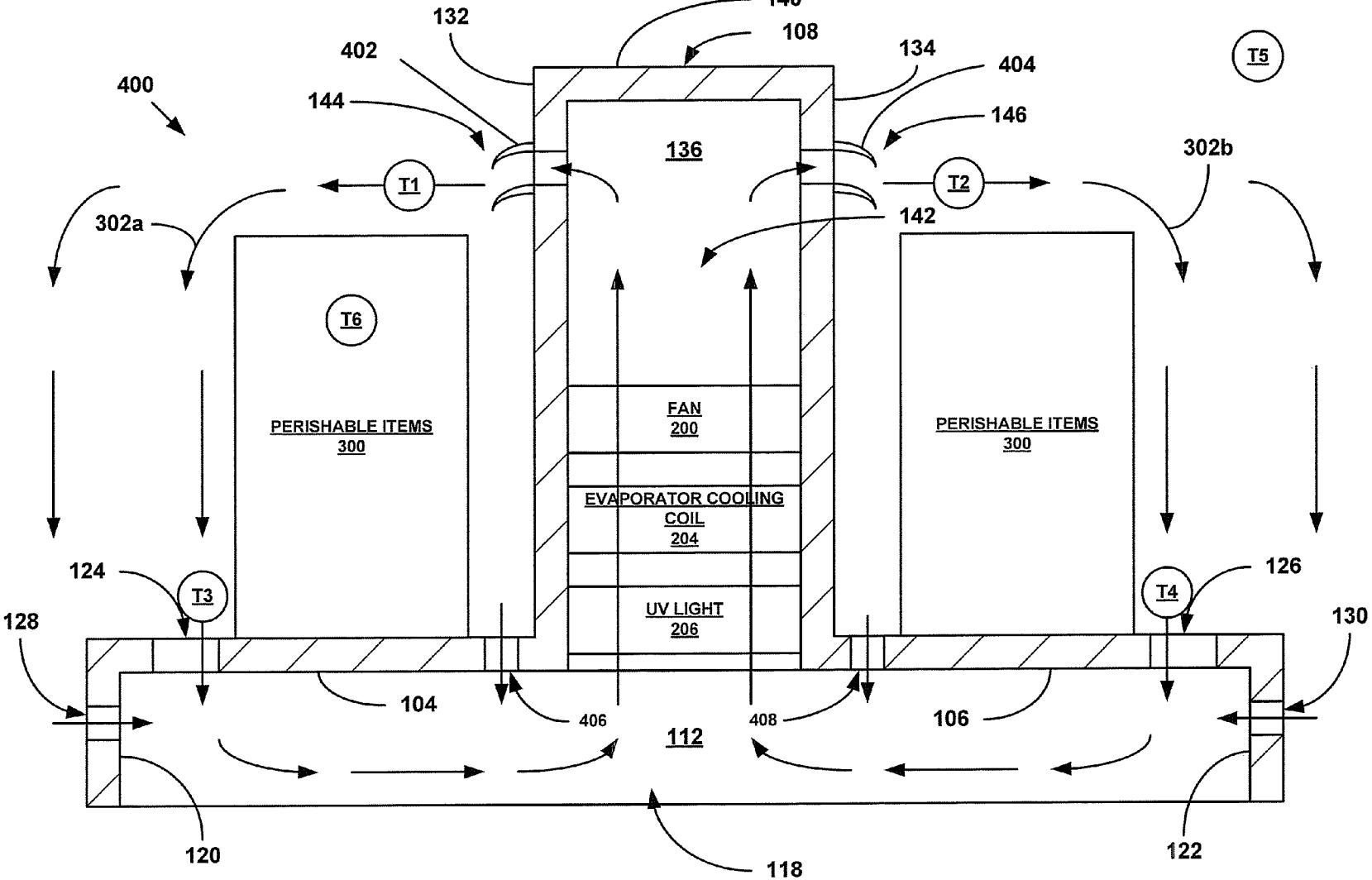
FIG. 16 is a schematic illustration of an exemplary embodiment of a system for cooling perishable items.

Referring to FIG. 16, an exemplary embodiment of an apparatus 400 for cooling perishable items is substantially identical in design and operation to the apparatus 100 with the addition of air flow guides, 402 and 404, and passageways, 406 and 408. In particular, the flow guides, 402 and 404, are coupled to the vertical side walls, 132 and 134, respectively, of the housing 102 for guiding the flow of air out of the passageways, 144 and 146, respectively. The flow paths provided by the flow guides, 402 and 404, direct the air flow in a downward direction onto and over the perishable items 300 positioned on the horizontal sections, 104 and 106, of the apparatus 400. The passageways, 406 and 408, are defined within the horizontal sections, 104 and 106, respectively, of the housing 102 of the apparatus 100 proximate the vertical side walls, 132 and 134. In an exemplary embodiment, during the operation of the apparatus 400, air may be drawn into the hollow portions, 116 and 118, of the housing 102 of the apparatus.

In an exemplary experimental embodiment of the apparatus 400, the apparatus was operated and the operating temperatures of the air flow and the perishable food items 300 were monitored at various locations within the apparatus. In particular, the temperature was monitored at the following locations during the operation of the apparatus 400:

| Item | Location of Temperature Monitored | Operating Temperature |
|---|---|---|
| T1 | Discharge from passageway 144 | 38 F. |
| T2 | Discharge from passageway 146 | 36 F. |
| T3 | Inlet to passageway 124 | 49 F. |
| T4 | Inlet to passageway 126 | 49 F. |
| T5 | Ambient | 69 F. |
| T6 | Food items | 38 to 45 F. |

The exemplary experimental results described and illustrated above were unexpected.

In an exemplary embodiment, the system 230 may include one or more of the apparatus 100 and/or 400.

Figure 17:
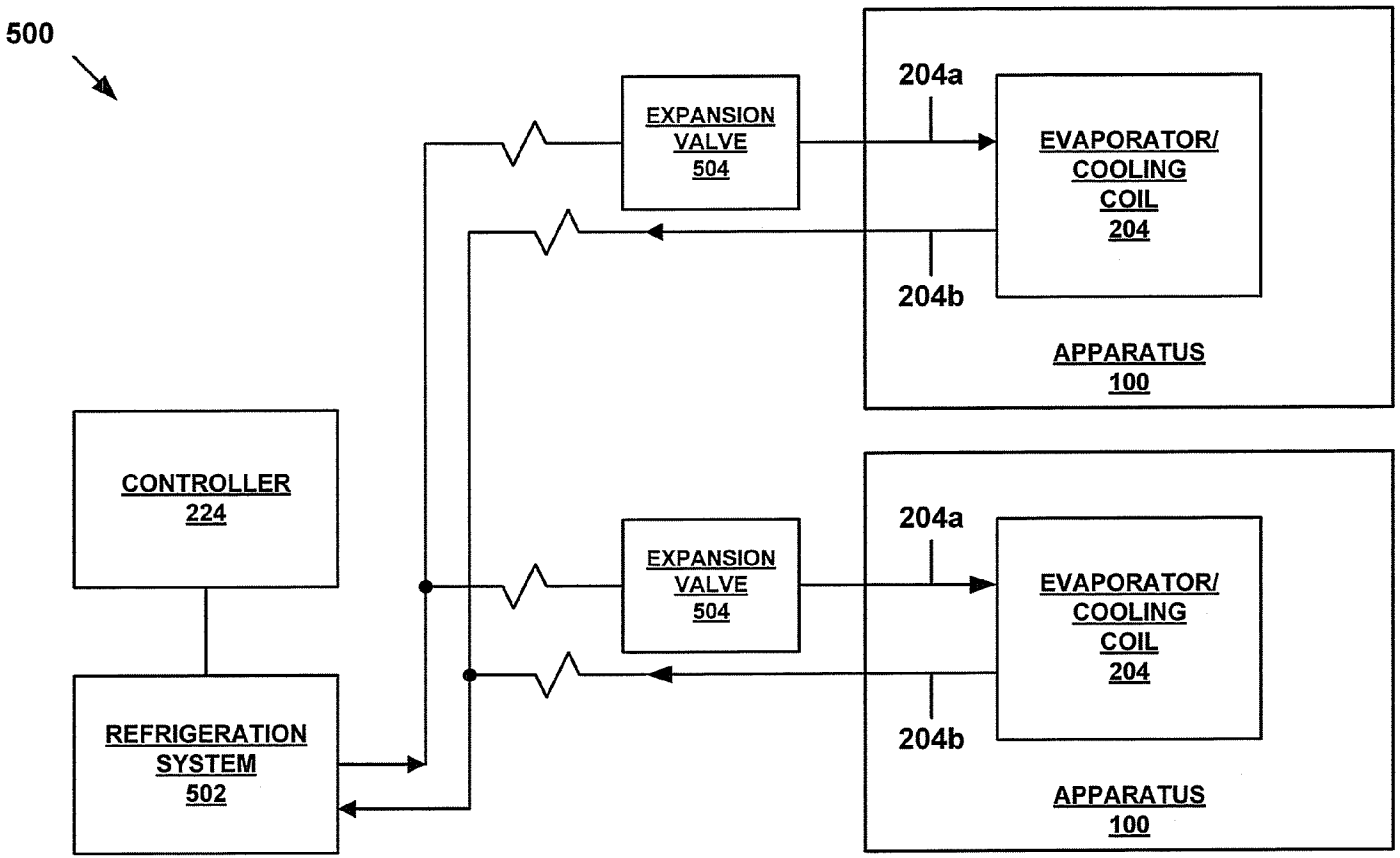
FIG. 17 is a schematic illustration of an exemplary embodiment of a system for cooling perishable items.

Referring now to FIG. 17, an exemplary embodiment of a system 500 for cooling perishable items is substantially identical in design and operation to the system 230 with the exception that a conventional refrigeration system 502 is substituted for the pump 220 and source of chilled fluid 222, the outlet valves 218 are removed, and expansion valves 504 are provided on the inlet sides of the evaporator coils 204.

Figure 18:
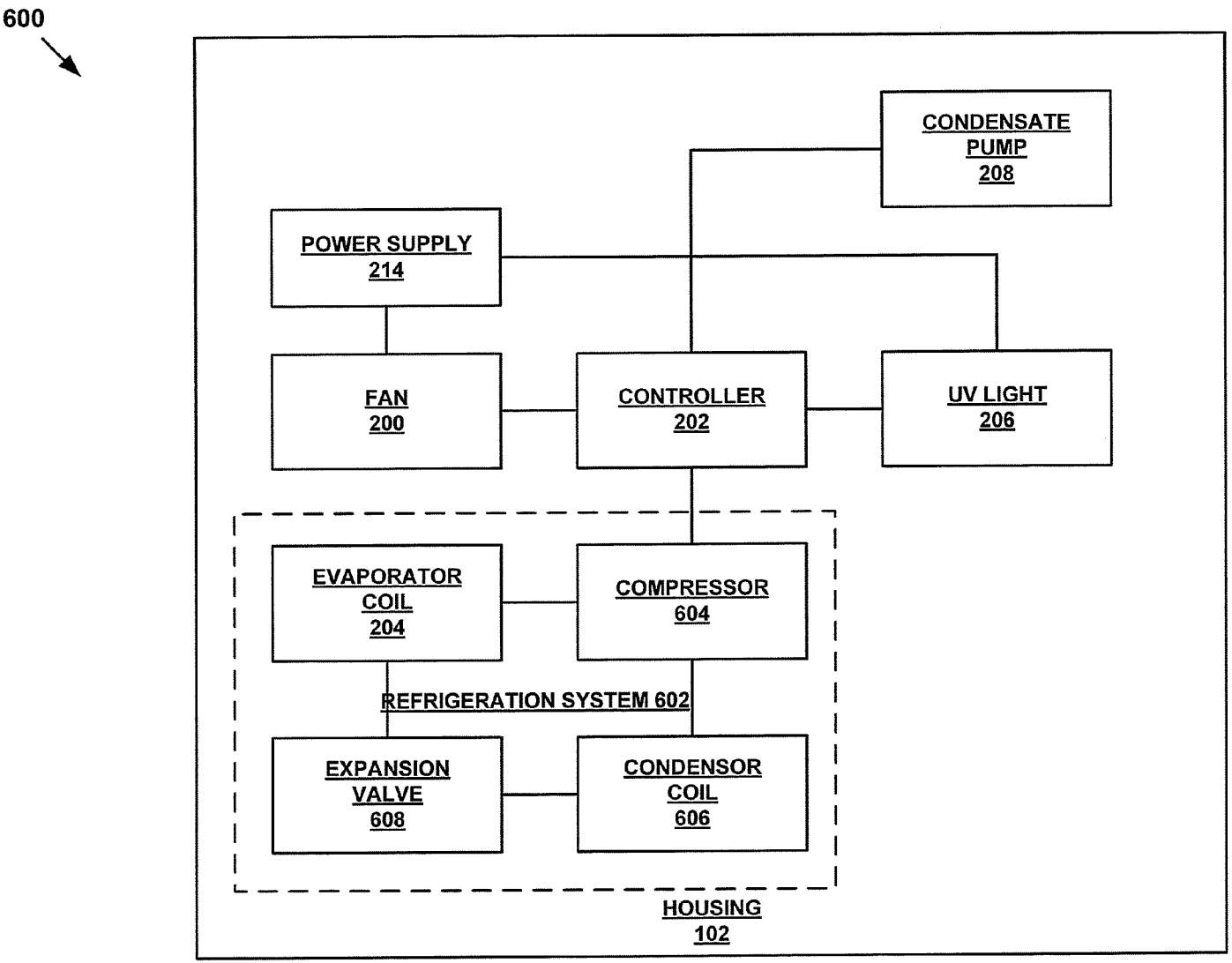
FIG. 18 is a schematic illustration of an exemplary embodiment of a system for cooling perishable items.

Referring to FIG. 18, an exemplary embodiment of an apparatus 600 for cooling perishable items is substantially identical in design and operation to the apparatus 100 with an on-board refrigeration system 602 that includes the evaporator coil 204, a compressor 604, a condenser coil 606 and an expansion valve 608 that are positioned within the housing 102 of the apparatus. The design and operation of the on-board refrigeration system 602 is conventional and permits the apparatus 600 to be a self-contained cooling system.

In an exemplary embodiment, the systems 230 and 500 may be combined with one or more of the apparatus 600.

Figure 19:
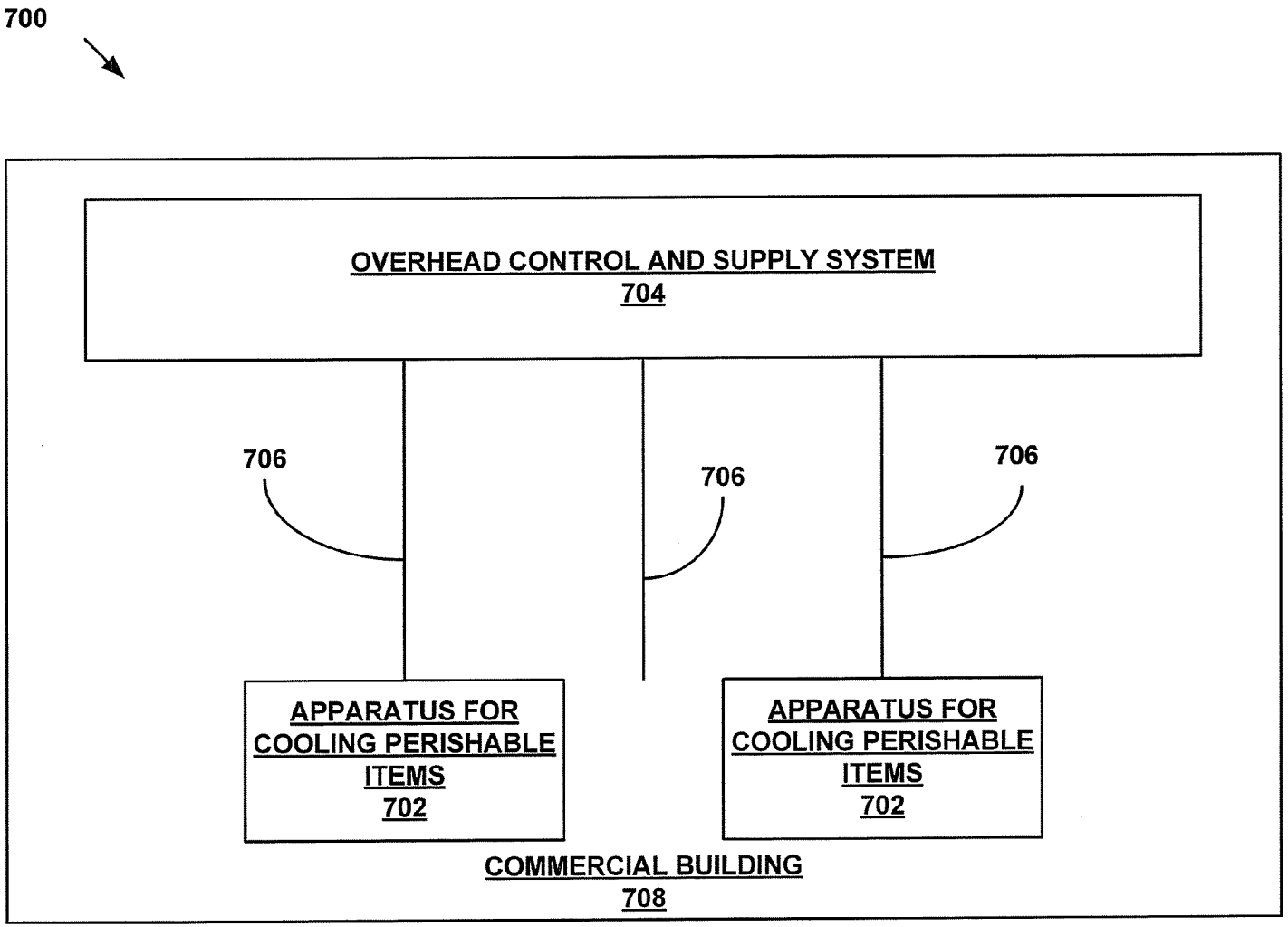
FIG. 19 is a schematic illustration of an exemplary embodiment of a system for cooling perishable items.

Referring now to FIG. 19, a system 700 for cooling produce, or other perishable items, includes one or more apparatus 702 for cooling perishable items that are each operably coupled to an overhead control and supply system 704 by corresponding releasable umbilicals 706. In an exemplary embodiment, the system 700 may be positioned within a commercial building 708 such as, for example, a warehouse sales establishment. In an exemplary embodiment, the apparatus 702 may be the apparatus 100 and/or 400. In an exemplary embodiment, the system 704 may include one or more of the pump 220, the source 222, the controller 224, or the refrigeration system 502. In an exemplary embodiment, the umbilicals 706 may permit cooling fluids to be circulated to the apparatus 702, electrical power and control signals to be provided to, and drainage of condensation to be removed from the apparatus.

In an exemplary embodiment, the system 700 further includes one or more unused umbilicals 706 that may permit one or more of the apparatus 702 to be repositioned within the building 708. In this manner, an operator of the commercial building 708 may easily reposition one or more of the apparatus 702 to adjust the flow of customers through the commercial building 708.

In an exemplary embodiment, the apparatus 100, 400, and 600 and the systems 230, 500, and 700 provide islands of displays for produce or other food items within a commercial establishment, without any side-wall or barrier panels of any kind.

In an exemplary embodiment, the apparatus 100, 400, and 600 direct a laminar flow of chilled air onto and over perishable food items 300. As a result, in an exemplary embodiment, a halo or compact zone of low temperature air surrounds the perishable items 300. In an exemplary embodiment, as perishable food items 300 are sold, personnel of the commercial establishment may remove the containers in which the perishable food items are presented on the systems. In an exemplary embodiment, the empty apparatus 100, 400, and 600 may then be removed by a fork lift operator and replaced with a new apparatus that is loaded with perishable food items 300.

In an exemplary embodiment, the use of the systems, 230, 500 and/or 700, in a commercial establishment permit the commercial establishment to provide a virtually unlimited number of traffic flow configurations. As a result, a novel buying experience may be provided that still maintains perishable items at their proper freshness and quality.

In an exemplary embodiment, the cooling fluid used in the systems 100 and/or 1102 is chilled water and glycol.

In an exemplary embodiment, one or more of the passageways, 144 and 146, of the housing 102 include nozzles that direct air flow within the circulation paths, 302*a* and 302*b*, over the perishable food items 300.

In an exemplary embodiment, the temperature of the coolant fluid that runs through the coils 204 and/or the air within the circulation paths, 302*a* and 302*b*, of the apparatus 100, 400 and/or 600 is monitored and fed back to the controllers 202 and/or the central controller 224.

In an exemplary embodiment, the condensate pump 208 of the apparatus 100, 400 and/or 600 is operated in combination with a timed defrost cycle which periodically permits ice that may collect on the coils 204 to defrost and then the moisture captured by the condensate drain pans 210.

In an exemplary embodiment, other types of conventional refrigeration systems be substituted for, or used in addition to, the coils 204 and/or the refrigeration system 602 to cool the air within the circulation paths, 302*a* and 302*b*.

It is understood that variations may be made in the above without departing from the scope of the invention. For example, the teachings of the present exemplary embodiments may be used to cool any item, whether a food item or not, and whether perishable or not. Further, spatial references are for the purpose of illustration only and do not limit the specific orientation or location of the structure described above. While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

The invention claimed is:

1. A system for cooling perishable items, comprising:

a housing adapted to rest on a surface that includes one or more platform surfaces for supporting perishable items and defines one or more air circulation paths for cooling the perishable items supported on the platform surfaces of the housing; a refrigeration system coupled to the housing for cooling the air circulation paths; and one or more umbilicals releasably coupled to the refrigeration system;

wherein one or more of the umbilicals extend upwardly from the housing.

2. The system of claim 1, wherein the housing comprises first and second horizontal platform surfaces for supporting perishable items.

3. The system of claim 2, wherein the housing comprises a vertical structure extending upwardly from the first and second horizontal surfaces that at least partially defines the air circulation paths.

4. The system of claim 3, wherein at least a portion of the refrigeration system is positioned within the vertical structure of the housing.

5. The system of claim 3, wherein the vertical structure is positioned between the first and second horizontal surfaces.

6. The system of claim 3, wherein the vertical structure defines one or more passages that define portions of the air circulation paths.

7. The system of claim 1, further comprising:

one or more disinfectant systems coupled to the housing for disinfecting the air circulation paths.

8. The system of claim 1, wherein the housing comprises a plurality of spaced apart supports for supporting the housing on the surface.

9. The system of claim 8, wherein the spaced apart supports define flow passages therebetween that comprise at least a portion of the air circulation paths.

10. The system of claim 1, wherein each of the air circulation paths comprise a laminar air flow path adapted to flow over the perishable items.

11. The system of claim 1, further comprising one or more retractable rollers coupled to the housing.

12. The system of claim 1, wherein the refrigeration system comprises a coil positioned within the housing; and the system further comprising:

a refrigeration system positioned outside of the housing that is operably coupled to the coil.

13. The system of claim 1, wherein the refrigeration system comprises a coil positioned within the housing; and the system further comprising:

a refrigeration system positioned within the housing that is operably coupled to the coil.

14. A system for cooling perishable items, comprising:

a housing adapted to rest on a surface that includes one or more platform surfaces for supporting perishable items and defines one or more air circulation paths for cooling the perishable items supported on the platform surfaces of the housing; and a refrigeration system coupled to the housing for cooling the air circulation paths; wherein the coil comprises an inlet and an outlet; and the system further comprising:

an inlet umbilical releasably coupled to the inlet of the coil and coupled to the refrigeration system; and an outlet umbilical releasably coupled to the outlet of the coil and coupled to the refrigeration system;

wherein the inlet and outlet umbilicals extend upwardly from the housing.

15. A system for cooling perishable items, comprising:

a housing adapted to rest on a surface that includes one or more platform surfaces for supporting perishable items and defines one or more air circulation paths for cooling the perishable items supported on the platform surfaces of the housing; and a refrigeration system coupled to the housing for cooling the air circulation paths;

wherein the coil comprises an inlet and an outlet; and the system further comprising:

an inlet umbilical releasably coupled to the inlet of the coil and coupled to the refrigeration system; and an outlet umbilical releasably coupled to the outlet of the coil and coupled to the refrigeration system;

wherein the inlet and outlet umbilicals extend upwardly from the housing; further comprising:

an inlet supply line positioned above the housing operably coupled to the refrigeration system that provides a supply of cooling fluid to the inlet umbilical;

an outlet return line positioned above the housing operably coupled to the refrigeration system that receives cooling fluid from the outlet umbilical;

one or more other inlet umbilicals operably coupled to the inlet supply line; and one or more other outlet umbilicals operably coupled to the outlet return line.

16. A system for cooling perishable items, comprising:

a housing adapted to rest on a surface that includes one or more platform surfaces for supporting perishable items and defines one or more air circulation paths for cooling the perishable items supported on the platform surfaces of the housing; and a refrigeration system coupled to the housing for cooling the air circulation paths;

wherein the coil comprises an inlet and an outlet; and the system further comprising:

an inlet umbilical releasably coupled to the inlet of the coil and coupled to the refrigeration system; and an outlet umbilical releasably coupled to the outlet of the coil and coupled to the refrigeration system;

wherein the inlet and outlet umbilicals extend upwardly from the housing; further comprising:

an inlet supply line positioned above the housing operably coupled to the refrigeration system that provides a supply of cooling fluid to the inlet umbilical;

an outlet return line positioned above the housing operably coupled to the refrigeration system that receives cooling fluid from the outlet umbilical;

one or more other inlet umbilicals operably coupled to the inlet supply line; and one or more other outlet umbilicals operably coupled to the outlet return line; wherein one or more pairs of the other inlet and outlet umbilicals are not operably coupled to corresponding inlets, and outlets of a coil.

17. A method of operating a commercial business within a building, comprising:

displaying perishable items on a portable cooling platform within the building at a first location;

flowing a chilled fluidic material through a coil positioned within the platform;

cooling an air stream by blowing air over the coil using a fan positioned within the platform;

cooling the perishable items on the portable cooling platform using the cooled air stream; and providing the chilled fluidic material to the coil from a refrigeration system provided outside of the platform using an umbilical releasably coupled to the coil;

wherein the umbilical extends upwardly from the platform.

18. The method of claim 17, further comprising:

permitting the chilled fluidic material to be provided to the coil from the refrigeration system at a plurality of separate chilled fluidic material supply connections provided within the building.

19. The method of claim 18, further comprising:

disconnecting the portable cooling platform from a chilled fluidic material supply connection provided at the first location;

relocating the portable cooling platform within the building at a second location; and connecting the portable cooling platform to a chilled fluidic material supply connection provided at the second location.

* * * * *